United States Patent [19]

Craig

[11] 3,997,057

[45] Dec. 14, 1976

[54] STACKING MEANS FOR PACKING TRAY

[75] Inventor: Edward P. Craig, Waterville, Maine

[73] Assignee: Keyes Fibre Company, Waterville, Maine

[22] Filed: Dec. 6, 1974

[21] Appl. No.: 530,172

[52] U.S. Cl. ..... 206/507; 217/26.5; 229/2.5 R

[51] Int. Cl.[2] ..... B65D 21/04; B65D 81/16

[58] Field of Search ..... 217/25.5, 26, 26.5; 229/2.5 EC, 2.5 R; 206/507

[56] References Cited

UNITED STATES PATENTS

| | | | |
|---|---|---|---|
| 1,983,325 | 12/1934 | Swift | 217/26.5 |
| 2,018,954 | 10/1935 | Guyer | 217/26 |
| 2,236,675 | 4/1941 | DeReamer | 217/26.5 |
| 2,936,922 | 5/1960 | Williams | 229/2.5 EC |
| 3,282,458 | 11/1966 | Rudd | 229/2.5 EC |
| 3,357,624 | 12/1967 | Crabtree | 217/26.5 |
| 3,451,577 | 6/1969 | Nurick | 217/26.5 |
| 3,675,806 | 7/1972 | Noguchi | 229/2.5 EC |

*Primary Examiner*—George E. Lowrance
*Attorney, Agent, or Firm*—Connolly and Hutz

[57] ABSTRACT

A nestable molded packing tray is disclosed having a compact arrangement of pockets for receipt of soft, delicate articles such as apples, tomatoes, etc. This tray contains post support means in the areas between closely adjacent pockets which materially increase the number of pockets which can be placed in a given tray. These support means coact with posts formed in the tray to space the trays when stacked and transmit vertical stacking forces to successive layers of trays in a manner which avoids damage to the packed articles. In one embodiment end flaps are added to the tray to provide additional support for successive layers of trays. The posts and post support means are molded into the trays in such a way that the trays will nest during shipment and may easily be stacked when ready for filling with articles to be packed.

8 Claims, 9 Drawing Figures

STACKING MEANS FOR PACKING TRAY

BACKGROUND OF THE INVENTION

The claimed invention relates to stackable packing trays designed for receipt of fragile or crushable articles such as fruit, vegetables and the like, and more particularly to a tray with novel means for maximizing the number of articles that can be packed in the tray. More particularly the claimed invention is directed to the novel location of post support means on said tray in an area between adjoining pockets thereby increasing the number of articles that can be stored in a given tray area. Posts are also molded into the trays to interact with these supports means in successive layers of trays to transmit vertical stacking forces through an area of the tray not occupied by stored articles, thus avoiding damage to these articles.

Prior to the present invention, packing trays for fragile articles such as fruit or vegetables were generally of the type wherein pockets had to be spaced apart a substantial distance in order to allow the placement of posts and/or support means in open areas between the pockets. Trays of this general type are shown in Friday U.S. Pat No. 3,245,570; Grant U.S. Pat. No. 2,656,945; and Friday U.S. Pat. No. 2,351,754. A substantial area on each of these prior art trays is occupied by posts and post support means which reduces the area available for pockets containing the stored articles. Another disadvantage of the prior art trays is the fact that vertical stacking forces are transmitted through the bottom of the pockets containing the stored article. When several of these prior art trays are stacked on top of each other these vertical forces exerted on the pocket bottom tend to dimple the pocket resulting in damage to the articles stored in the pockets.

Various attempts have been made to solve the problems of damage to stored articles inherent in these prior art trays including the use of double or dual posts which protrude both upwardly or downwardly from the plane of the tray with articles stored in the pockets between the posts. Such an arrangement is illustrated in DeReamer U.S. Pat. No. 2,236,675 but this approach has the disadvantage of substantially reducing the area on the tray which can be used for storage of articles.

SUMMARY OF THE INVENTION

This invention solves the foregoing problems and provides a molded packing tray having a plurality of article receiving pockets which in conjunction with strategically located posts support means provides a large area on the tray for storage of articles while protecting these articles from damage during shipment and/or storage. The posts and post support means are arranged in rows, preferably at the middle and towards the end of the tray, to provide three point support for successive layers when stacked.

The posts are designed to abut support means on the next tray stacked above it, the post support means being located between adjoining pockets. This configuration transmits vertical forces in the area between the pockets rather than into the bottom of the pockets avoiding crushing or bruising of stored articles and at the same time reduces the total area occupied by the posts and post support means. The post support means may be either a rib or a downwardly directed post.

To further maximize the area on a tray available for stored articles, the number of rows containing posts and post support means can be reduced in number and end flaps added to one or more edges of the tray. These end flaps are designed to automatically fold into position over articles stored in the end rows of the tray when the tray is placed in a shipping carton or case. The end flaps protect the articles covered by the flaps from forces exerted on the carton and further provide necessary spacing and vertical support between adjacent trays along that edge.

DETAILED DESCRIPTION OF THE DRAWINGS

Numerous advantages of the present invention will become apparent to one skilled in the art from a reading of the detailed description in conjunction with the accompanying drawings, wherein similar reference characters refer to similar parts and in which.

DETAILED DESCRIPTION OF THE INVENTION

Figure 1:
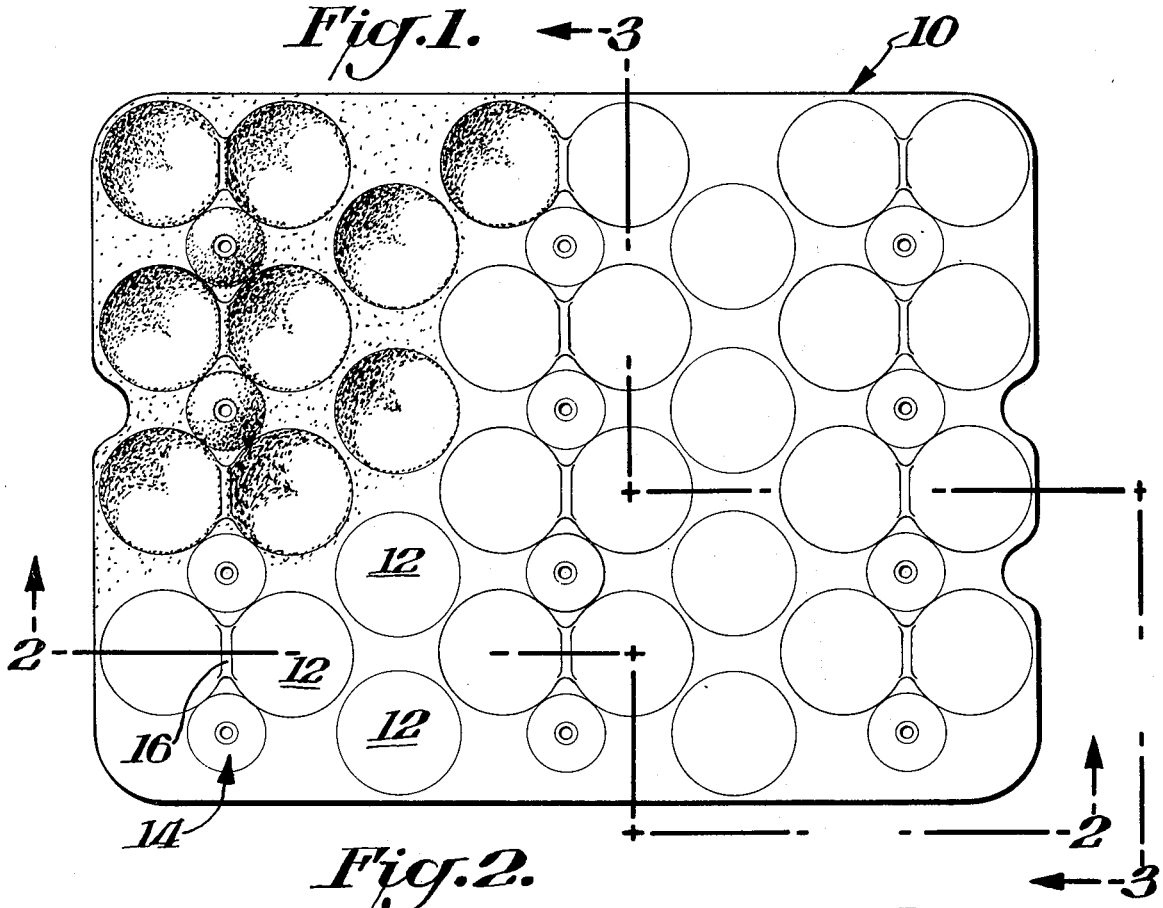
FIG. 1 is a plan view of one embodiment of the packing tray of this invention.

Referring in more particularity to the drawings, the several figures illustrate various embodiments of a molded packing tray 10. The tray 10 may be formed from a unitary sheet molded to final shape from fibers, pulp materials or plastic such as thermoplastic, either ejection molded or vacuum form extruded or foam sheets, all according to known techniques. The tray 10 is shaped to define a plurality of article receiving pockets 12 and a plurality of upwardly directed posts 14 arranged in two or more rows. The number of rows to be used, of course, would depend upon the size of the tray and the number of articles to be stored but normally three rows in the approximate locations illustrated in FIG. 1 would be used. This configuration maximizes the amount of fruit, vegetables or other articles which can be stored in a given area.

As shown in FIGS. 2–4, 6 and 7 the upwardly directed posts 14 are circular in cross section having steeply sloped sides 15. While circular posts are illustrated, posts having rectangular, octagonal or similar shapes may also be used. Preferably the posts 14 have a height which is approximately twice the diameter of a section taken halfway up the post's height. This configuration maximizes the strength of the post while minimizing the area on the tray 10 occupied by the post 14.

Figure 2:
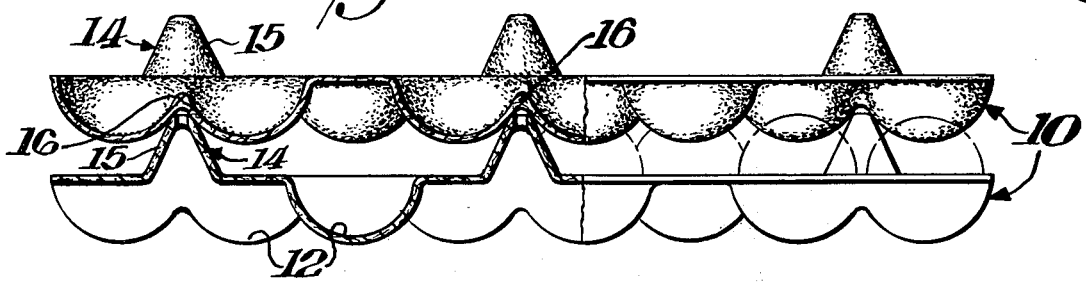
FIG. 2 is a front elevational view in partial cross section along line 2–2 of FIG. 1 showing two trays according to this invention in a stacked arrangement.
Figure 3:
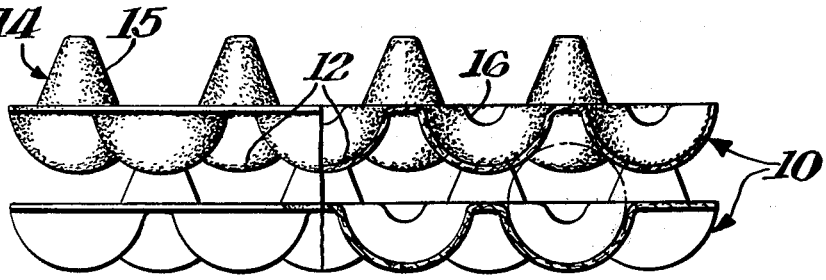
FIG. 3 is a side elevational view in partial cross section along line 3–3 of FIG. 1 showing the spacing of the trays of this invention when arranged in the stacked configuration.

When the trays 10 of this invention are stacked, the posts 14 are designed to abut the underside of the tray above it at a post support means 16 which in the embodiments illustrated in FIGS. 1–3 is a saddle-shaped rib under the area where two pockets 12 adjoin. This configuration minimizes the area occupied by the stacking means (post 14 and post support means 16) thus maximizing the area on the tray 10 available for articles to be stored. This configuration also assures that all stacking forces transmitted from one tray to another bypass the actual stored articles and are transmitted directly to the strong, reinforced rib of the post support means 16, thus reducing damage to the stored articles.

Figure 5:
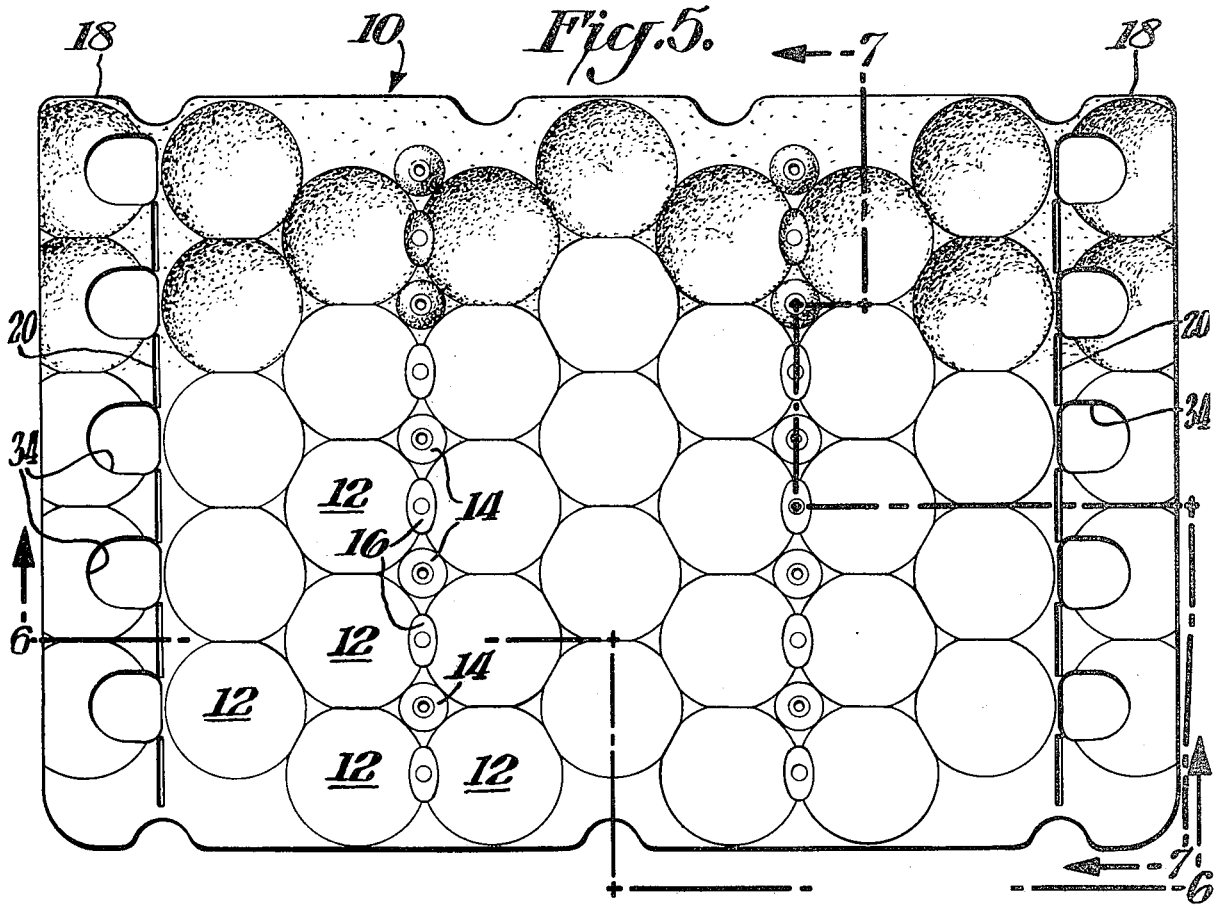
FIG. 5 is a plan view of another embodiment of the packing tray of this invention utilizing end flaps.
Figure 6:
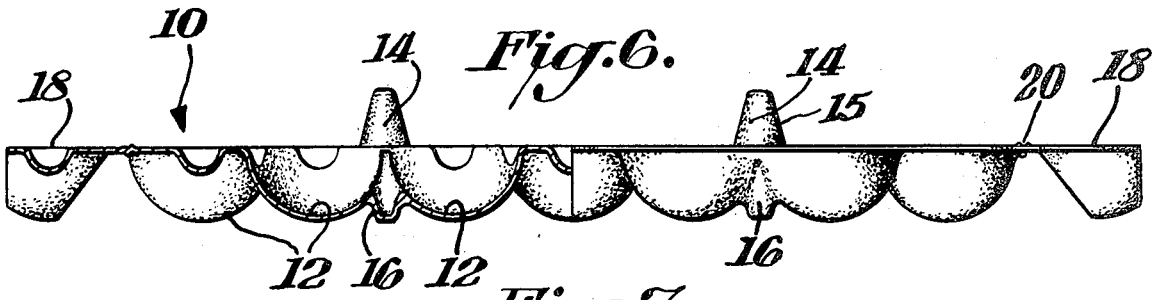
FIG. 6 is a front elevational view in partial cross section along the line 6–6 of FIG. 5.
Figure 7:
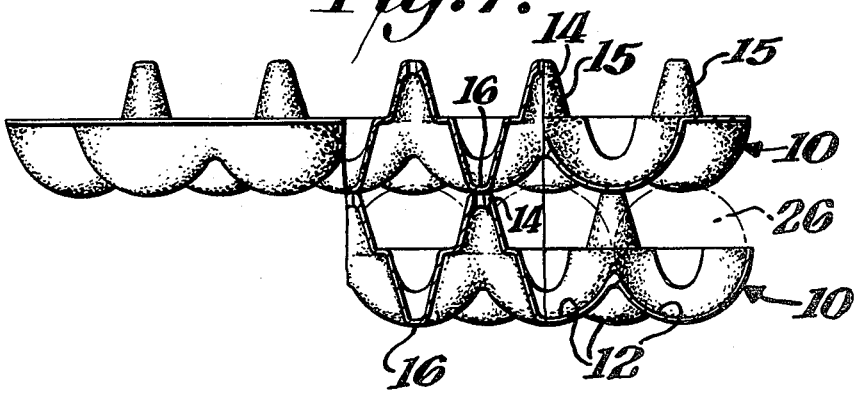
FIG. 7 is a partial transverse sectional view along line 7–7 of FIG. 5 showing the mating relationship of the post and post support means of adjoining trays.

Another form of post support means 16 is illustrated in FIGS. 5–6 and comprises a downwardly directed post which, like the rib in FIGS. 1–3, is located in the area where two pockets 12 adjoin. This form of post support means 16 like-wise achieves the desired objectives of maximizing the number of articles that can be stored while minimizing damage to these articles.

Unlike the prior art where post support means are located on the bottom of pockets or in open areas between pockets, this invention places these means in the reinforced area between adjoining or abutting pockets. More particularly, they are placed in the area defined as the midpoint of an imaginary line drawn between the centers of adjoining pockets, where that line is equal to the diameter of the pockets. With this cnfiguration it is not necessary to space the pockets apart to accommodate post support means as was done in the prior art, e.g. DeReamer U.S. Pat. No. 2,236,675. The novel location and configuration of applicant's post support means 16 thus opens up substantially the entire area of the tray 10 for placement of pockets 12 containing stored articles. To further maximize utilization of space on the trays 10, the posts 14 and post support means 16 are aligned in rows. The number of rows in each tray and the number of posts 14 and post support means 16 in each row will be dictated by considerations of size and weight of the articles to be stored.

The packing tray 10 illustrated in FIGS. 1–3 is a 32-count tray, i.e., it will hold 32 articles to be stored. One means of increasing the count in tray 10 is illustrated in FIGS. 5''7. In this embodiment of tray 10 the number of rows of posts 14 and post support means 16 is reduced to two and end flaps 18 are added to provide the support lost by omission of one row. This rearrangement of rows and addition of end flaps increases the article count to 35.

Figure 8:
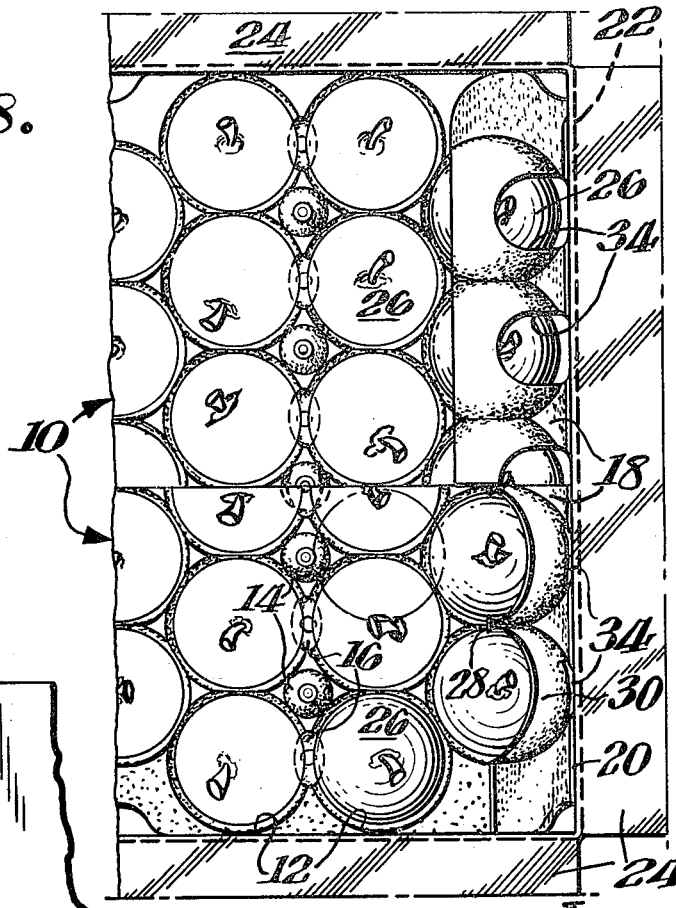
FIG. 8 is a partial top plan view of one embodiment of the tray of this invention showing the end flaps in a fully closed and partially closed position over an end row of stored articles.
Figure 9:
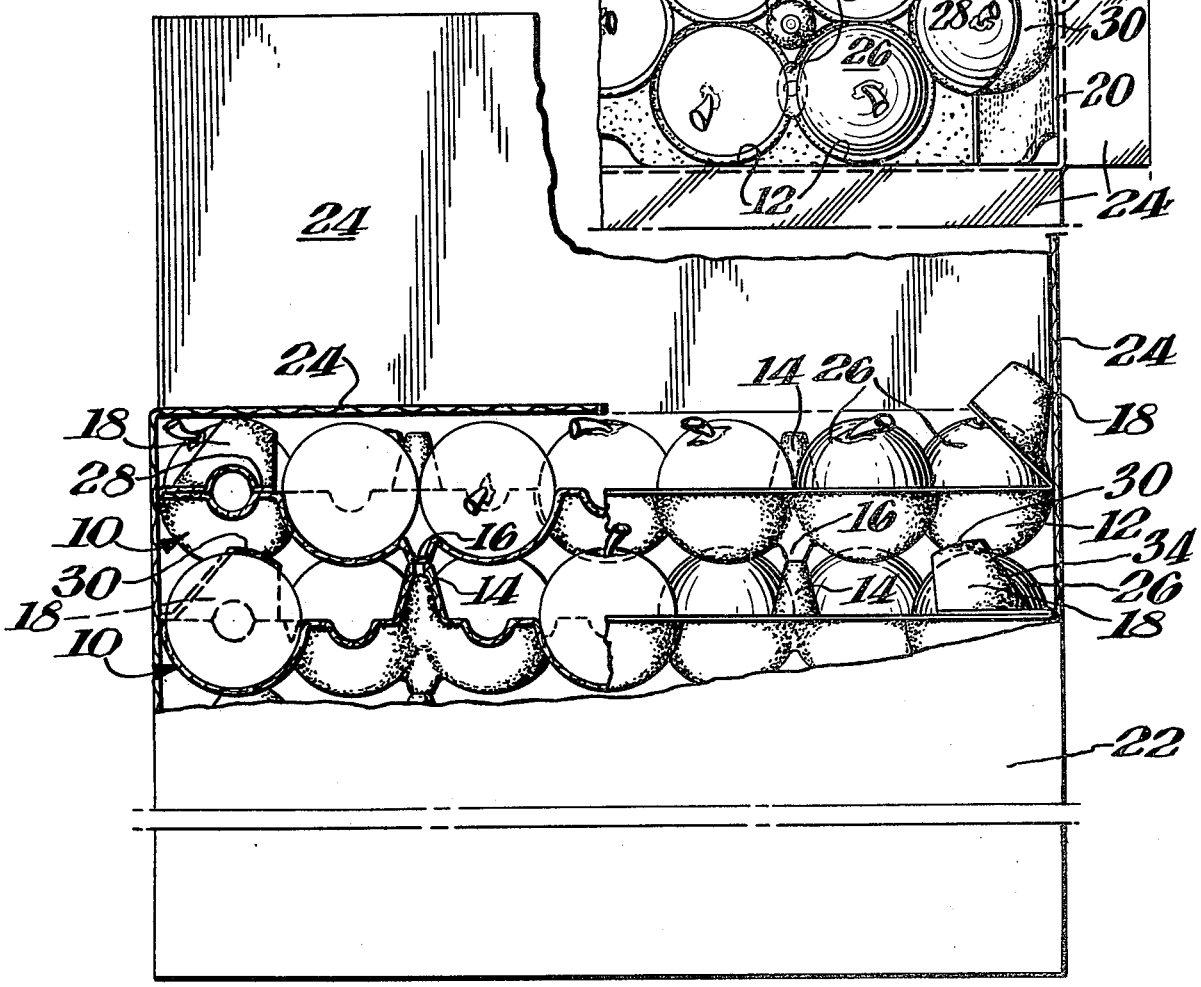
FIG. 9 is a front elevational view partially broken away illustrating multiple trays of the type shown in FIGS. 5–8 stacked in a carton or case.

The end flaps 18 are scored or cut out along the inner edge 20 thereof to form a hinge which facilitates movement of the end flap into a position protecting the end row of fruit as illustrated in FIG. 9. After the pockets 12 of the tray 10 shown in FIGS. 5–9 are filled with fruit or other articles to be stored the tray is placed in a case or carton 22. The flaps 24 of the carton are left open and as the tray 10 is lowered into the carton 22 the end flaps 18 of tray 10 are automatically rotated about hinge 20 to cover the end row of stored articles 26. Upon placement of additional trays 10 in the carton 22 the upper edge 28 of end flap 18 comes into abutting contact with the surface of the tray 10 thus providing a rigid hemispherical shield over the articles 26. The upper surface 30 of end flap 18 provides edge support for subsequent trays 10 placed in the carton 22.

End flaps 18 contain windows 34 that register with the product receiving pockets 12 when the flaps are in the closed position as shown in FIGS. 8 and 9. The windows 34 provide relief of irregular surfaces or contours on the stored articles 26 thereby preventing damage thereto.

Figure 4:
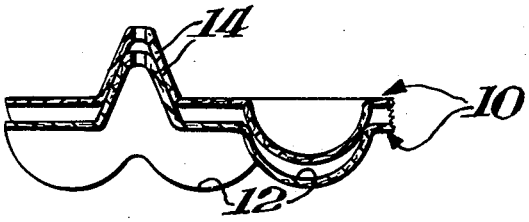
FIG. 4 is a fragmental cross section of the trays of this invention shown in a nesting configuration.

The tray 10 of this invention is also designed to facilitate shipment of the trays before insertion of articles therein. As shown in FIG. 4 the trays, when leaving the factory and prior to use in the field, can easily be nested to maximize the number of trays per given size of shipping container. When the trays 10 reach the area where they are to be used, they need only be rotated 180° to each other in order to porperly align the posts 14 with the post support means 16 on the underside of the next successive tray 10. Alternatively, "A" and "B" trays which are mirror images of each other can be used to obtain the necessary stacking alignment.

While the above described embodiments constitute the present preferred mode of practicing the invention, other embodiments and equivalents are within the scope of the actual invention which is claimed as follows:

1. A molded packing tray having a first plane with multiple rows of downwardly dished article receiving pockets extending below said plane, multiple rows of upwardly directed support posts extending above said plane, a majority of the article receiving pockets closely adjoining each other whereby at least a portion of the upper walls of the closely adjoining pockets at the point where they intersect the plane are contiguous, multiple rows of support means below said plane, substantially all of the support means underlying the contiguous intersection of the closely adjoining pockets with said plane, the rows of support means being located to rest on cooperating rows of support posts of a like tray positioned therebelow to avoid transmittal of stacking forces through the bottom of the article receiving pockets and to sufficiently space the tray from a tray therebelow to allow storage of articles between the trays, the pockets, posts and support means of said tray being arranged so that the tray when empty of articles may be compactly nested with other like trays for shipping or storing.

2. A molded packing tray as in claim 1 wherein the support means is located on a line between the centers of the closely adjoining pockets.

3. A molded packing tray as in claim 2 wherein the closely adjoining pockets are generally circular when viewed perpendicular to the plane and the length of the line between the centers of two closely adjoining pockets is equal to the diameter of one pocket.

4. A molded packing tray as in claim 1, wherein the support means comprises a saddle shaped rib.

5. A molded packing tray as in claim 1 wherein the support means comprises a downwardly tapering hollow post.

6. A molded packing tray as in claim 1 wherein the number of said rows of pockets is at least double the number of rows of support means.

7. The molded packing tray is in claim 1 wherein the support means and support posts are aligned in the same row.

8. A molded packing tray as in claim 1 wherein an end flap is hinged to at least one edge of said tray, the end flap adapted to be folded over the articles in the pockets adjacent the edge of the tray to provide support for a tray positioned thereabove stack spaced apart for storage of articles.

* * * * *